US008869358B2

(12) United States Patent
Wanzenboeck et al.

(10) Patent No.: US 8,869,358 B2
(45) Date of Patent: Oct. 28, 2014

(54) BAR-TYPE BRASSIERE FASTENER

(71) Applicants: Karl Wanzenboeck, Teesdorf (AT); Gerhard Fildan, Vienna (AT)

(72) Inventors: Karl Wanzenboeck, Teesdorf (AT); Gerhard Fildan, Vienna (AT)

(73) Assignee: Dubrosky & Tracy Patent Service Corp., Hong Kong (CN)

( * ) Notice: Subject to any disclaimer, the term of this patent is extended or adjusted under 35 U.S.C. 154(b) by 0 days.

(21) Appl. No.: 13/735,008

(22) Filed: Jan. 6, 2013

(65) Prior Publication Data

US 2014/0189987 A1 Jul. 10, 2014

(51) Int. Cl.

| | |
|---|---|
| ***A44B 13/00*** | (2006.01) |
| ***A41F 1/00*** | (2006.01) |
| ***A41C 3/00*** | (2006.01) |
| ***A41C 3/12*** | (2006.01) |

(52) U.S. Cl.

CPC ..... *A41C 3/122* (2013.01)
USPC ..... 24/666; 24/591.1

(58) Field of Classification Search

USPC ..... 24/697.1, 666, 591.1, 465, 466, 578.12, 24/667, 698.1; 450/63
See application file for complete search history.

(56) References Cited

U.S. PATENT DOCUMENTS

| | | | | |
|---|---|---|---|---|
| 5,427,562 | A * | 6/1995 | Hwang | 450/58 |
| 7,128,635 | B1 * | 10/2006 | Liu | 450/39 |
| D623,987 | S * | 9/2010 | Fildan et al. | D11/208 |
| 2009/0070969 | A1 * | 3/2009 | Fildan et al. | 24/465 |
| 2010/0101058 | A1 * | 4/2010 | Fildan et al. | 24/578.14 |

* cited by examiner

*Primary Examiner* — Robert J Sandy
*Assistant Examiner* — Rowland Do
(74) *Attorney, Agent, or Firm* — Andrew Wilford

(57) ABSTRACT

A fastener for interconnecting two garment straps has a male part having an elongated base anchored to one of the straps, a web projecting transversely from the base, and a bar fixed to the web at a spacing from the base and having a pair of ends. A female part has a back panel secured to the other of the straps and a front panel. The back panel forms a recess dimensioned to receive the bar and having at a back edge back corners. The front panel forms ears spaced at the corners from the back panel and dimensioned such the male part can fit with the female part with the connecting bar engaging the back edge of the recess with its ends under the corners and its web projecting out of the recess between the ears.

3 Claims, 6 Drawing Sheets

BAR-TYPE BRASSIERE FASTENER

FIELD OF THE INVENTION

The present invention relates to a garment fastener. More particularly this invention concerns a bar-type fastener for a garment such as a brassiere.

BACKGROUND OF THE INVENTION

Brassiere fasteners, typically used between the back straps or "wings" of the garment although also sometimes used in front between the cups, exist in many variations. The classic old system has a male member, for example a hook, on one strap and a female member, for example an eye, on the other strap. For adjustability a row of the female members may be used so that the user can adjust tightness of the garment depending on which eye the hook is engaged with.

The male and female members exist in many different formats, with the most modern versions injection-molded of plastic as described in commonly owned U.S. Pat. Nos. 7,407,430, 7,708,617, D623,987, 8,186,025, and 8,230,559.

OBJECTS OF THE INVENTION

It is therefore an object of the present invention to provide an improved garment fastener.

Another object is the provision of such an improved garment fastener that is both particularly easy to use so that it can be fastened and unfastened easily behind the back if necessary, while not coming unfastened unintentionally.

The fastener should also be inexpensive to manufacture, and should have a low profile so that it is not visible under another garment.

SUMMARY OF THE INVENTION

A fastener for interconnecting two garment straps has according to the invention a male part having an elongated base anchored to one of the straps, a web projecting transversely from the base, and a bar fixed to the web at a spacing from the base and having a pair of ends. A female part has a back panel secured to the other of the straps and a front panel. The back panel forms a recess dimensioned to receive the bar and having at a back edge back corners. The front panel forms ears spaced at the corners from the back panel and dimensioned such the male part can fit with the female part with the connecting bar engaging the back edge of the recess with its ends under the corners and its web projecting out of the recess between the ears.

Thus the fastener can be closed simply by slipping the bar of the male part into the recess and shifting the two parts so that the bar engages against the back edge of the recess under the catch ears. The result is not only a double engagement of the two parts together, but engagement at two spaced locations to provide a twist-free and stable mating of the two fastener parts.

According to the invention the recess is rectangular and has a long dimension parallel to its back edge. Respective textile tapes are bonded to the parts and in turn connected to the straps. Each of the tapes has a pair of layers between which the respective strap is sandwiched and to which the respective strap is bonded.

The garment fastener further has according to the invention a stiffener plate between the tapes of the male part. The male part is anchored to the stiffener plate. To make an adjustable-length fastener, a plurality of the male parts are anchored to the stiffener plate.

BRIEF DESCRIPTION OF THE DRAWING

The above and other objects, features, and advantages will become more readily apparent from the following description, reference being made to the accompanying drawing in which.

DETAILED DESCRIPTION

Figure 1:
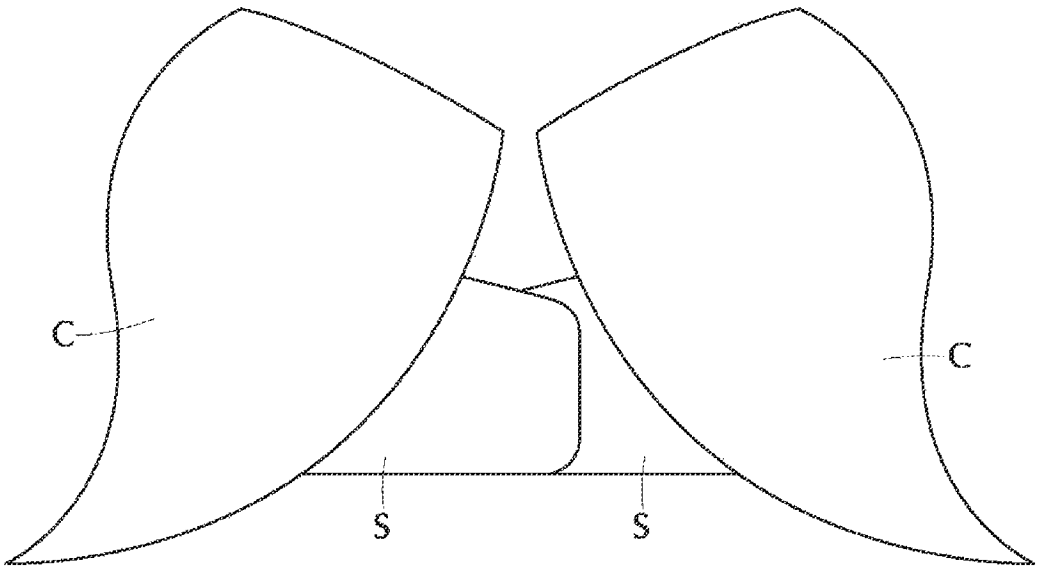
FIG. 1 is a small-scale partial front view of a brassiere with the fastener of this invention.

As seen in FIG. 1 a typical brassiere has a pair of cups C interconnected by respective straps S that are secured together by a fastener. Such an arrangement can also be used in the back of the garment between the wings or back straps.

Figure 4:
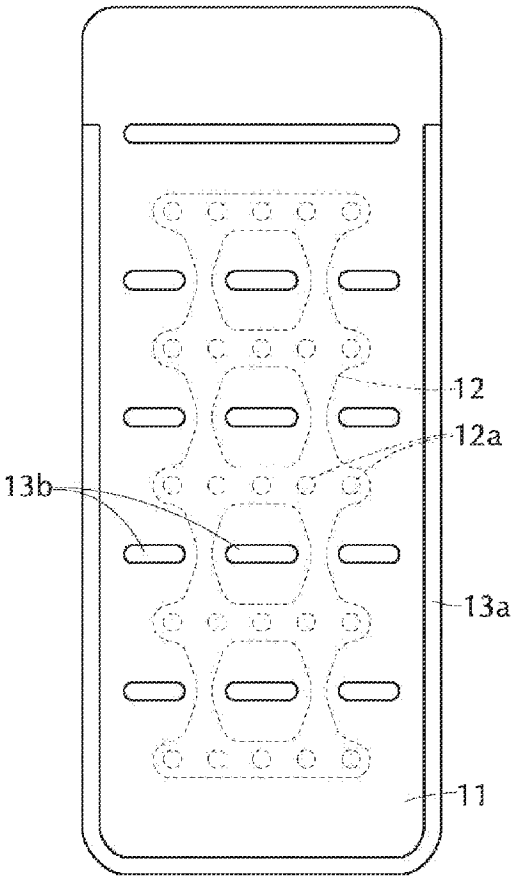
FIG. 4 is a front view of the multiple male part
Figure 3:
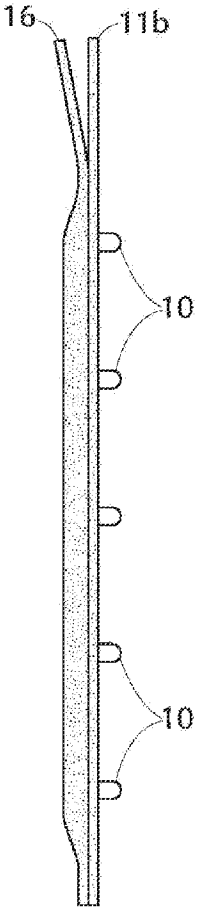
FIG. 3 is a side view of the multiple male part.
Figure 2:
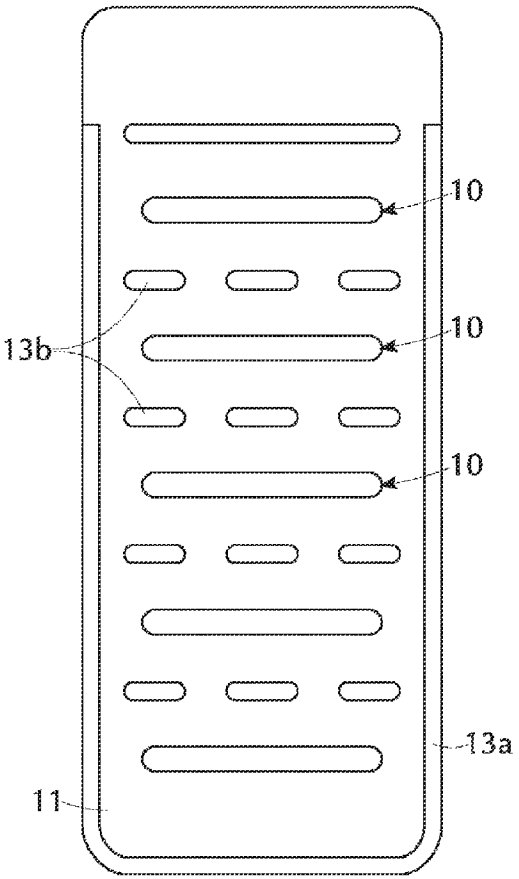
FIG. 2 is a back view of a multiple male part of a fastener according to the invention.

According to the invention the fastener comprises, for a front fastener, a single male part 10, and for a back fastener a row of such parts 10, normally working with a single female part 20. FIGS. 2-5, 8, and 9, show five male parts 10 carried on a tape 11 having front and back layers 11*a* and 11*b* adapted to be laminated to opposite faces of the end of one of the back straps. The layers 11*a* and 11*b* sandwich a plastic stiffener 12 (FIG. 4). A U-shaped peripheral weld 13*a* and transverse spot welds 13*b* secure the layers 11*a* and 11*b* together on opposite faces of the stiffener 12.

The male part 10 as shown in FIGS. 5, 10, 11, and 12 has an elongated base bar 10*a* formed with a five pointed rivets 10*b* and a longer parallel top bar 10*c* so that ends 10*d* of the top bar 10*c* project past the base 10*a*, all unitarily formed from plastic by injection molding. Such a male part 10 is secured in place by the rivets 10*b* that are pressed through holes 12*a* of the stiffener 12, fitted in holes 10*e* of an anchor bar 10*b* and then upset ultrasonically to lock the assembly together, with the rivets 10*b* normally extending through the layer 11*b*. A flexible layer 10*g* laminated to the bar 10*f* assists in anchoring it in the layers 11*a* and 11*b*.

Figure 22:
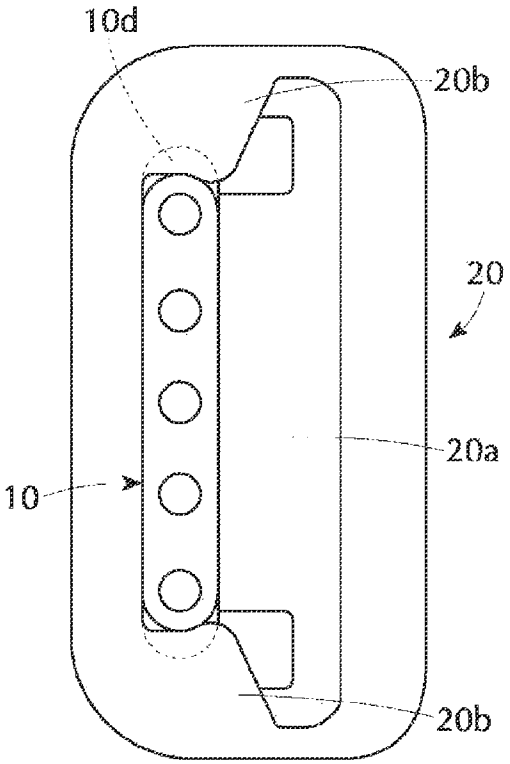
FIG. 22 is a view like FIG. 21 showing the male part fitted to the female part.
Figure 21:
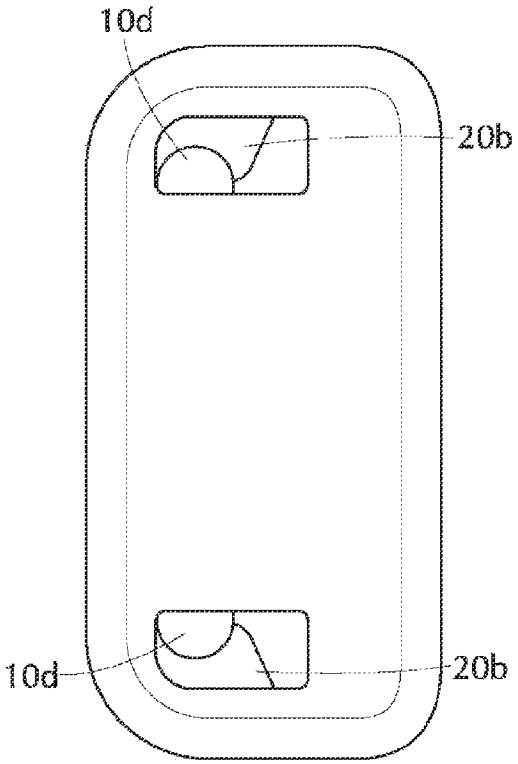
FIG. 21 is a view like FIG. 20 showing the male part fitted to the female part.
Figure 20:
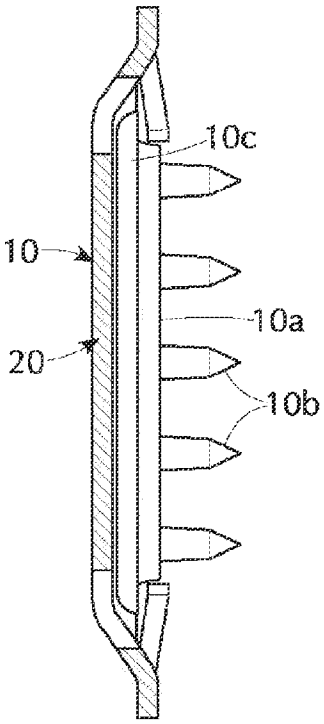
FIG. 20 is a view like FIG. 19 showing the male part fitted to the female part.

The female part 20 has a back panel forming a rectangular recess 20*a* and a front panel forming at corners of a long back edge of the recess 20 a pair of catch ears 20*b*. The back panel is also formed aligned with the ears 20*b* with holes 20*c* that primarily are provided to make forming the part 20 in a two-part mold possible. The female part 20 and male part 10 are so dimensioned that the outer bar 10*c* of the male part 10 can be slipped into the recess 20*a* and engaged with its ends 10*b* under the catch ears 20*b* as shown in FIGS. 20-22.

Figure 9:
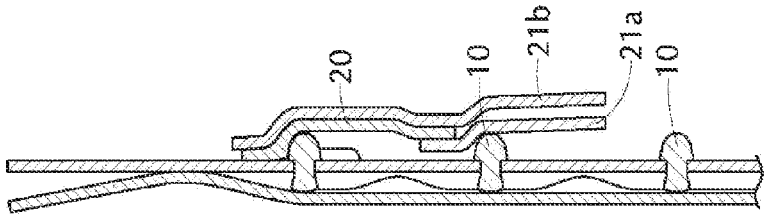
FIG. 9 is a longitudinal section taken along line IX-IX of FIG. 7.
Figure 8:
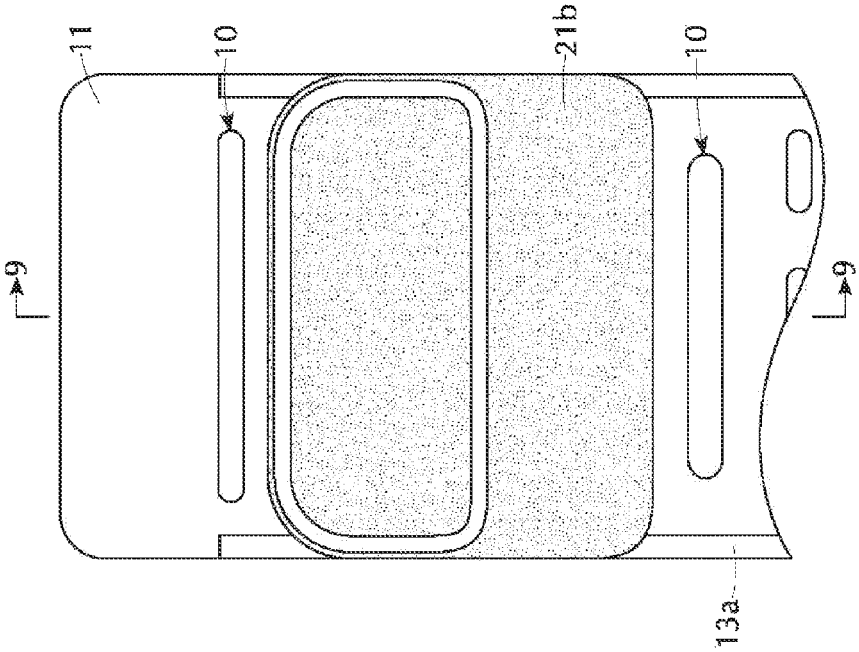
FIG. 8 is a larger-scale back view of the female part fitted to the multiple male part.
Figure 5:
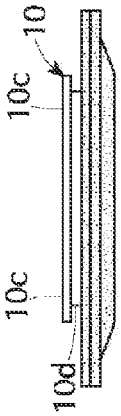
FIG. 5 is an end view of the multiple male part.
Figure 6:
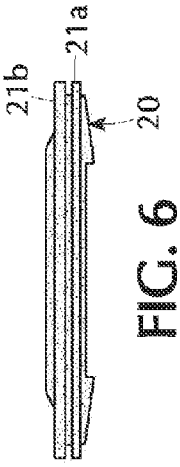
FIG. 6 is an end view of the female part.
Figure 7:
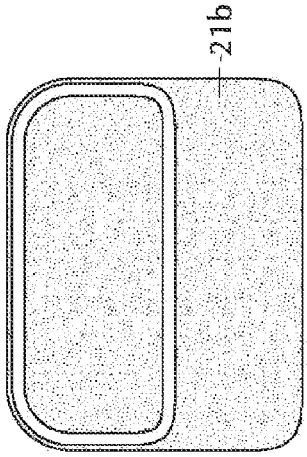
FIG. 7 is a back view of the female part.
Figures 10, 11, 12, 13, 14, 15:
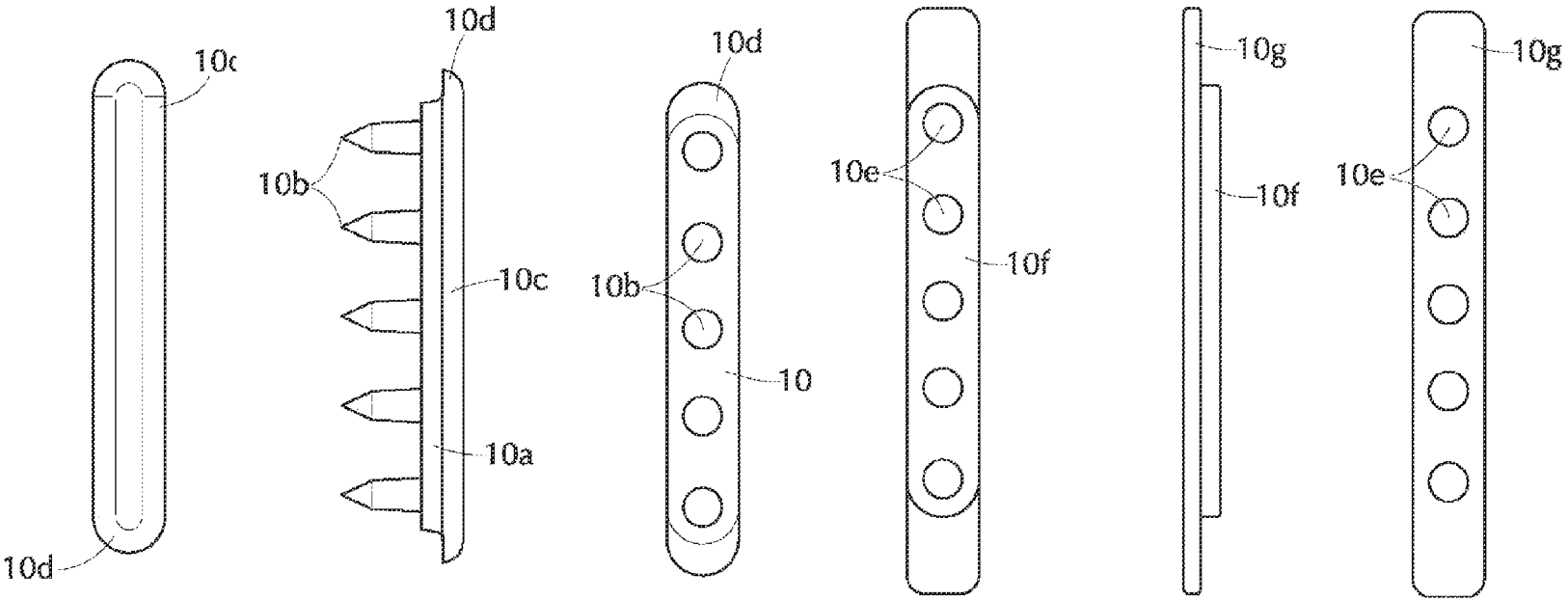
FIG. 10 is a back view of a single male part.
FIG. 11 is a side view of a single male part.
FIG. 12 is a front view of the single male part.
FIG. 13 is a front view of an anchor bar for the male part.
FIG. 14 is a side view of the anchor bar.
FIG. 15 is a back view of the anchor bar.
Figure 19:
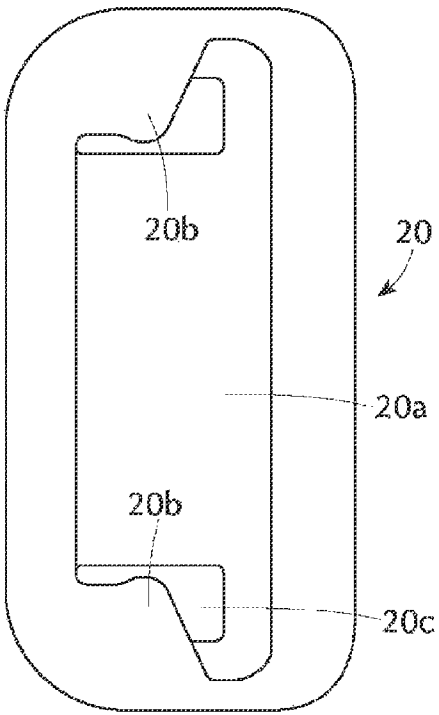
FIG. 19 is a back view of the female part.
Figure 16:
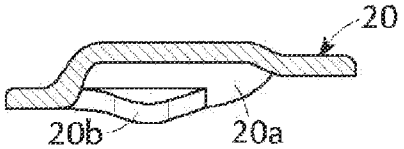
FIG. 16 is a longitudinal section through the female part.
Figure 18:
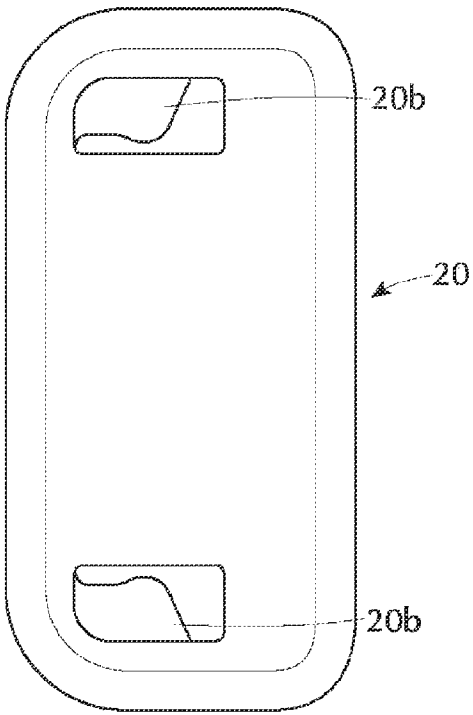
FIG. 18 is a front view of the female part.
Figure 17:
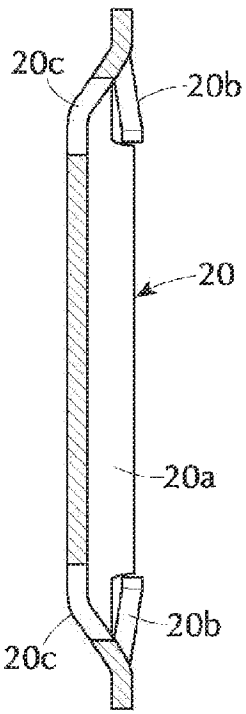
FIG. 17 is a cross section through the female part.

This female part 20, which like the male part 10 is molded in one piece from plastic, is typically secured as shown in FIG. 9 to the inner face of an inner layer 21*a*. An outer layer 21*b* is in turn laminated to the inner layer 21*a* and a strap is normally bonded between the layers 21*a* and 21*b* offset from the female part 20.

We claim:

1. In combination with two garment straps, a fastener for interconnecting the two garment straps, the fastener comprising:

a plurality of male parts each comprising an elongated base anchored to one of the straps, a web projecting transversely from the base, and a bar fixed to the web at a spacing from the base and having a pair of ends;

a female part having a back panel secured to the other of the straps and a front panel, the back panel forming a plurality of recesses each dimensioned to receive a respective one of the bars and having at a back edge back corners, the front panel forming in each of the recesses ears spaced at the corners from the back panel and dimensioned such that the male parts can fit with the recesses of the female part with the connecting bars engaging the back edges of the respective recesses with their ends under the respective corners and their webs projecting out of the recesses between the respective ears;

respective textile tapes bonded to the parts and in turn connected to the straps; and a stiffener plate between the tapes of the male part, the male parts being anchored to the stiffener plate.

2. The garment fastener defined in claim 1, wherein each recess is rectangular and has a long dimension parallel to its back edge.

3. The garment fastener defined in claim 1, wherein each of the tapes has a pair of layers between which the respective strap is sandwiched and to which the respective strap is bonded.

* * * * *